US008714786B2

(12) United States Patent
Huang et al.

(10) Patent No.: US 8,714,786 B2
(45) Date of Patent: May 6, 2014

(54) LAMP

(71) Applicant: Sunonwealth Electric Machine Industry Co., Ltd., Kaohsiung (TW)

(72) Inventors: Kuo-Hao Huang, Kaohsiung (TW); Wen-Nan Chou, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 13/655,303

(22) Filed: Oct. 18, 2012

(65) Prior Publication Data

US 2013/0094226 A1 Apr. 18, 2013

(30) Foreign Application Priority Data

Oct. 18, 2011 (TW) ..... 100137704 A

(51) Int. Cl.
*F21V 29/02* (2006.01)

(52) U.S. Cl.
USPC ..... 362/373; 362/249.02; 362/294

(58) Field of Classification Search
USPC ..... 362/547, 294, 218, 373, 96, 249.02, 362/311.02
See application file for complete search history.

(56) References Cited

U.S. PATENT DOCUMENTS

| | | | | |
|---|---|---|---|---|
| 7,144,135 | B2 | 12/2006 | Martin et al. | |
| 8,057,071 | B2 | 11/2011 | He et al. | |
| 2006/0193139 | A1* | 8/2006 | Sun et al. | 362/373 |
| 2010/0020537 | A1* | 1/2010 | He et al. | 362/234 |
| 2010/0027270 | A1* | 2/2010 | Huang et al. | 362/310 |
| 2010/0149807 | A1* | 6/2010 | Hu et al. | 362/249.02 |
| 2010/0172144 | A1* | 7/2010 | Liu | 362/373 |
| 2010/0253223 | A1* | 10/2010 | Inoue et al. | 315/82 |
| 2010/0259934 | A1* | 10/2010 | Liu et al. | 362/294 |
| 2010/0264799 | A1* | 10/2010 | Liu et al. | 313/46 |
| 2010/0265727 | A1* | 10/2010 | Liu | 362/373 |

FOREIGN PATENT DOCUMENTS

| | | | |
|---|---|---|---|
| TW | M346743 | U | 12/2008 |
| TW | M347528 | U | 12/2008 |
| TW | I327633 | B | 7/2010 |
| TW | 201128130 | A | 8/2011 |
| TW | M412318 | U | 9/2011 |

* cited by examiner

*Primary Examiner* — Laura Tso
(74) *Attorney, Agent, or Firm* — Muncy, Geissler, Olds & Lowe, P.C.

(57) ABSTRACT

A lamp includes a base, a cooling fan and a circuit board. The base has a coupling portion, with a LED member mounted on the base. The cooling fan has a frame coupled with the coupling portion of the base, wherein the frame receives a driving unit and a fan wheel coupling with the driving unit in a rotatable way and has a first fixing portion. The circuit board has a second fixing portion coupling with the first fixing portion of the frame, with the circuit board electrically connecting with the driving unit of the cooling fan.

20 Claims, 6 Drawing Sheets

LAMP

BACKGROUND OF THE INVENTION

1. Field of the Invention

The present invention generally relates to a lamp and, more particularly, to a lamp having a cooling fan to cool a circuit board in the lamp.

2. Description of the Related Art

Referring to FIG. 1, an invention of Taiwan Patent No. I327633, entitled as "LED Lamp," is shown. The invention is about a conventional lamp 9 including a body 91, a circuit board 92, a connecting unit 93 and an illuminating unit 94. The body 91 has a plurality of air inlets 911. The circuit board 92 has a plurality of through holes 921. The connecting unit 93 has a plurality of coupling tubes 931 aligning with the through holes 921 of the circuit board 92. The illuminating unit 94 has a fan 941 mounted on a heat sink 942, with the heat sink 942 coupling with a LED member 943 for the fan 941 and heat sink 942 to cool the LED member 943.

However, there are some problems shown in the following when the conventional lamp 9 is in use. First, it is so inconvenient to assemble this lamp 9 since the circuit board 92 and illuminating unit 94 are separately arranged on two opposite sides of the connecting unit 93 and wires electrically linking the circuit board 92 and the fan 941 have to pass through the connecting unit 93. Second, only the electrical elements on the upper surface of the circuit board 92 facing the air inlets 911 can be efficiently cooled when airflows are drawn into the body 91 by the fan 941 via the air inlets 911 since the lower surface of the circuit board 92 faces and is enclosed by the connecting unit 93, and thus the electrical elements on the lower surface of the circuit board 92 with high temperature may easily be broken and shorten the lifetime of the lamp 9. As a result, it is necessary to improve the conventional lamp 9.

SUMMARY OF THE INVENTION

It is therefore the objective of this invention to provide a lamp convenient in carrying out the electrical connection between a circuit board and a cooling fan, so as to enhance the assembling convenience thereof.

It is another objective of this invention to provide a lamp enabling a cooling fan to directly dissipate the heat generated by a circuit board, so as to increase the lifetime of the lamp.

One embodiment of the invention discloses a lamp, which includes a base, a cooling fan and a circuit board. The base has a coupling portion, with a LED member mounted on the base. The cooling fan has a frame coupled with the coupling portion of the base, wherein the frame receives a driving unit and a fan wheel coupling with the driving unit in a rotatable way and has a first fixing portion. The circuit board has a second fixing portion coupling with the first fixing portion of the frame, with the circuit board electrically connecting with the driving unit of the cooling fan.

In a preferred form shown, the lamp further comprises a housing with a receiving room inside, wherein an assembly opening is formed at an end of the housing and communicates with the receiving room, with the base, cooling fan and circuit board being arranged in the receiving room.

In the preferred form shown, a plurality of positioning holes is formed at another end of the housing, a plurality of electric connection pins is arranged on an edge of the circuit board to extend through the positioning holes of the housing, and the circuit board is firmly positioned between the housing and the frame.

In the preferred form shown, electrical elements are arranged on at least one surface of the circuit board, with the at least one surface being between the second fixing portion and the electric connection pins, and the second fixing portion of the circuit board is adjacent to the cooling fan and the electric connection pins are adjacent to the positioning holes of the housing for the circuit board inside the housing to be in a standing state.

In the preferred form shown, an inner wall of the receiving room adjacent to the assembly opening serves as an air guiding wall, and an air channel is formed between the frame of the cooling fan and the air guiding wall of the housing.

In the preferred form shown, the coupling portion of the base comprises a plurality of thread holes, an outer periphery of the frame has a plurality of through holes, the housing has a plurality of apertures, each aperture is aligned with a respective one of the through holes of the cooling fan and a respective one of the thread holes of the base, and fixing members pass through the apertures and through holes to engage in the thread holes.

In the preferred form shown, the first fixing portion of the frame comprises two slits aligning with each other, the second fixing portion of the circuit board is an edge of the circuit board, and the edge is inserted into the two slits of the frame.

In the preferred form shown, the edge serving as the second fixing portion has two blocks, these two blocks are spaced with a distance, and the two blocks engage two outmost surfaces of a lateral wall having the two slits respectively.

In the preferred form shown, the two slits are formed in two axial protrusions of a lateral wall of the frame.

In the preferred form shown, the second fixing portion of the circuit board is an edge including two slits, the first fixing portion of the frame is an end of a lateral wall of the frame facing the circuit board, and the lateral wall of the frame is fixed in the two slits of the second fixing portion of the circuit board.

In the preferred form shown, the base is a heat sink with a plurality of cooling fins.

In the preferred form shown, one end of the base has a light transmittable bulb for covering the LED member.

In the preferred form shown, the base includes at least one air guiding passage extending from one end of the base to another end of the base.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
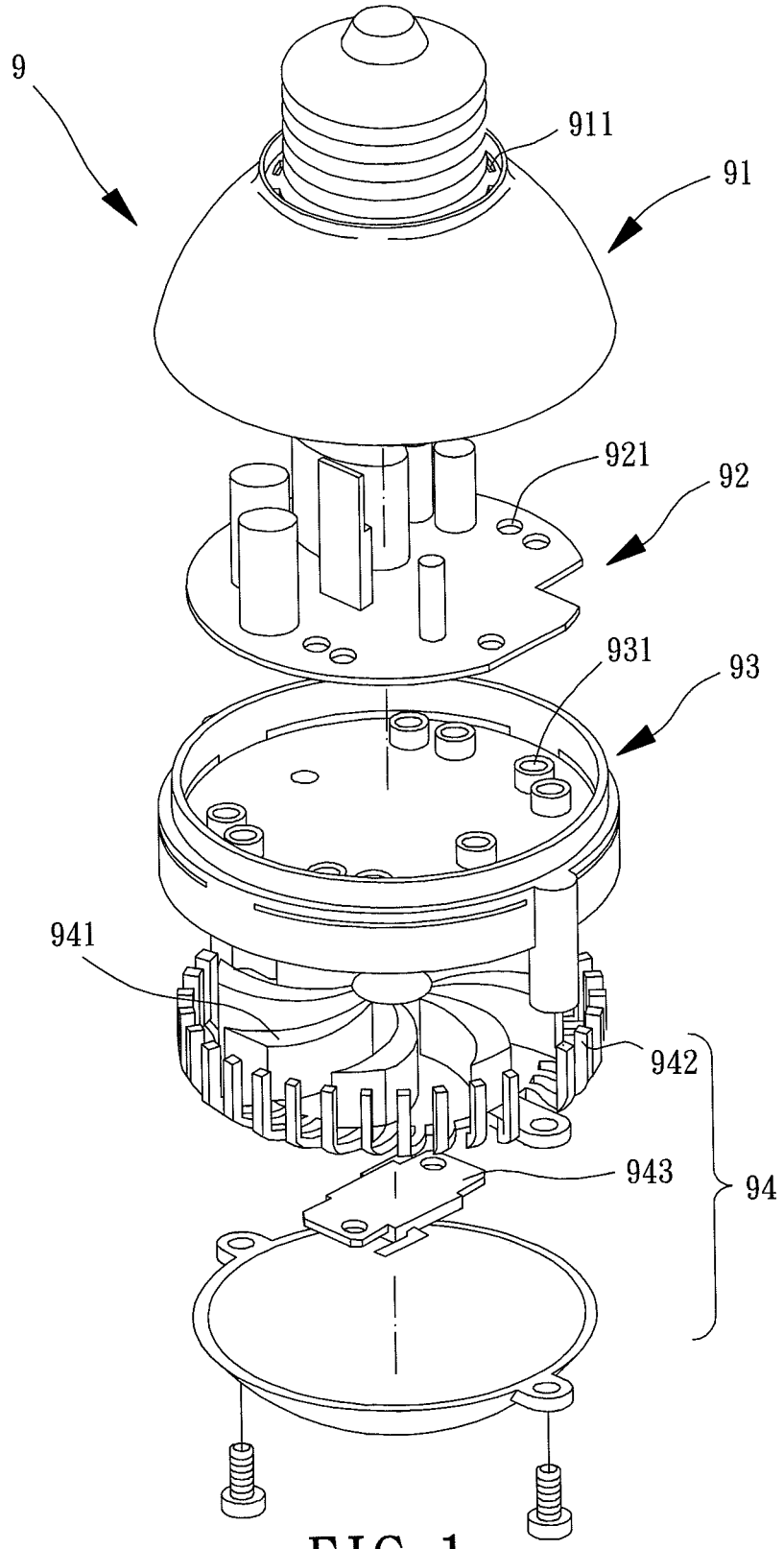
FIG. 1 PRIOR ART
FIG. 1 is a perspective and exploded view of a conventional lamp.

In the various figures of the drawings, the same numerals designate the same or similar parts. Furthermore, when the term "first," "second," and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
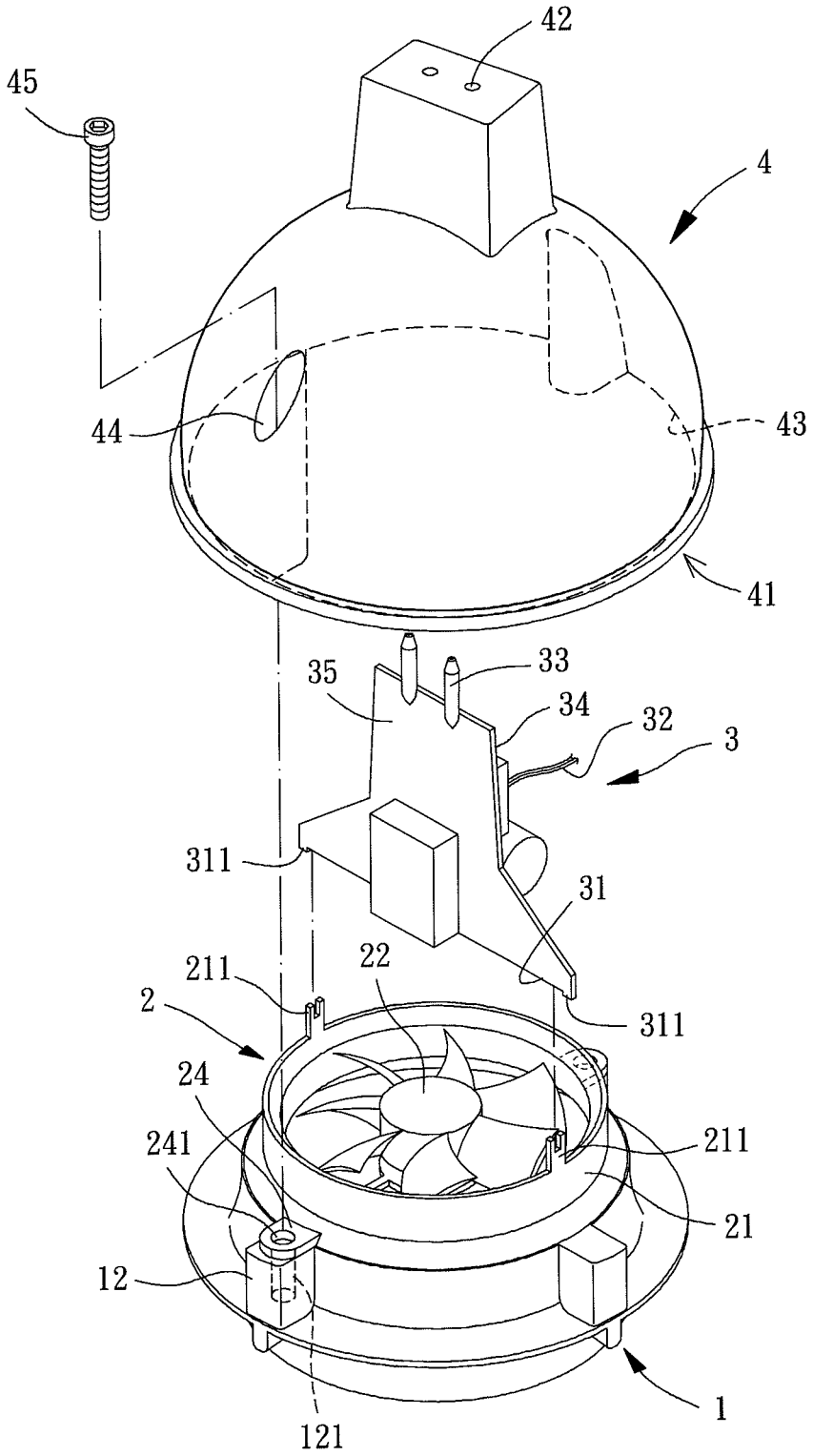
FIG. 2 is a perspective and exploded view of a lamp according to a first embodiment of the invention.
Figure 3:
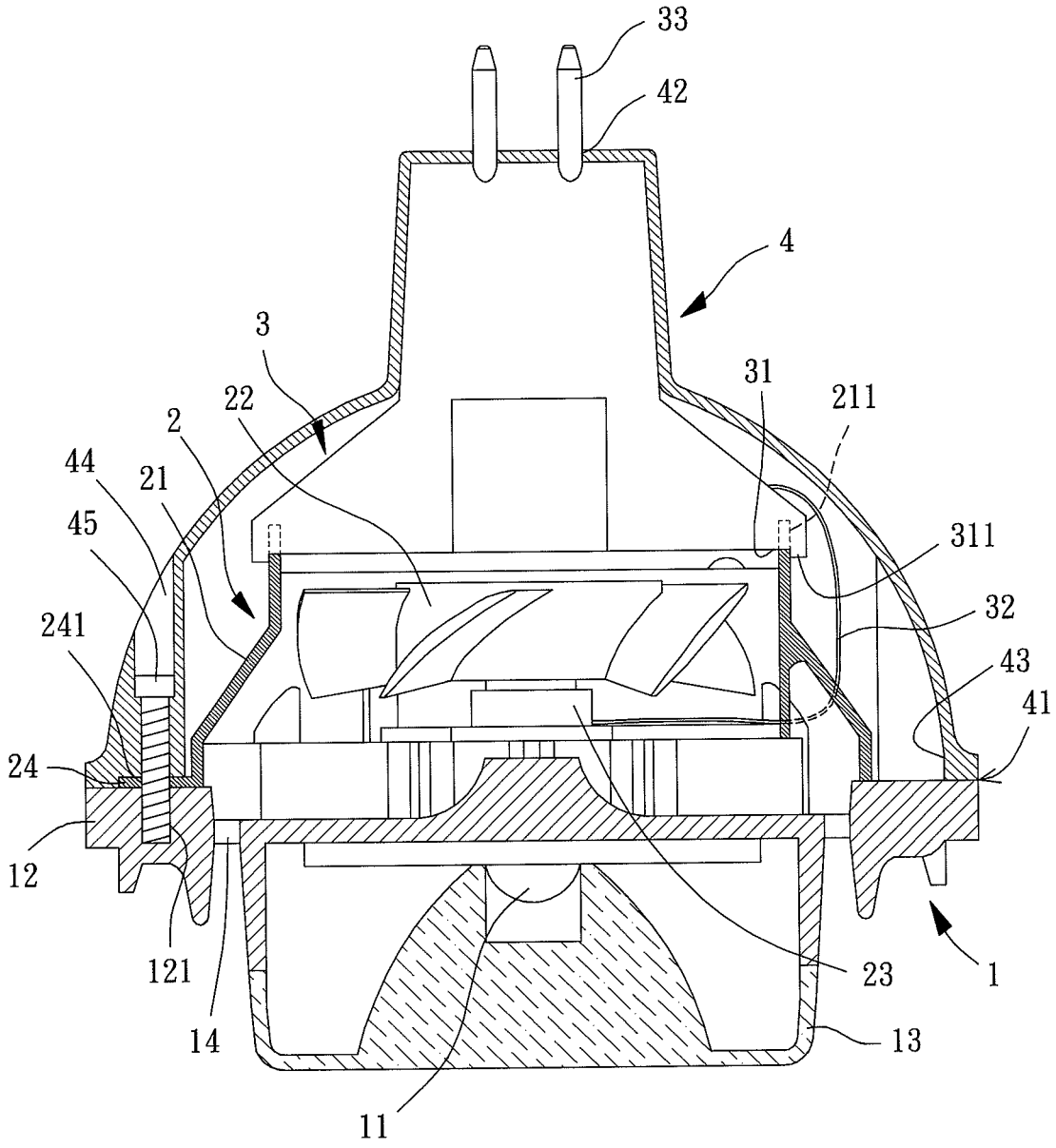
FIG. 3 is a cross-sectional view of the lamp according to the first embodiment of the invention.
Figure 4:
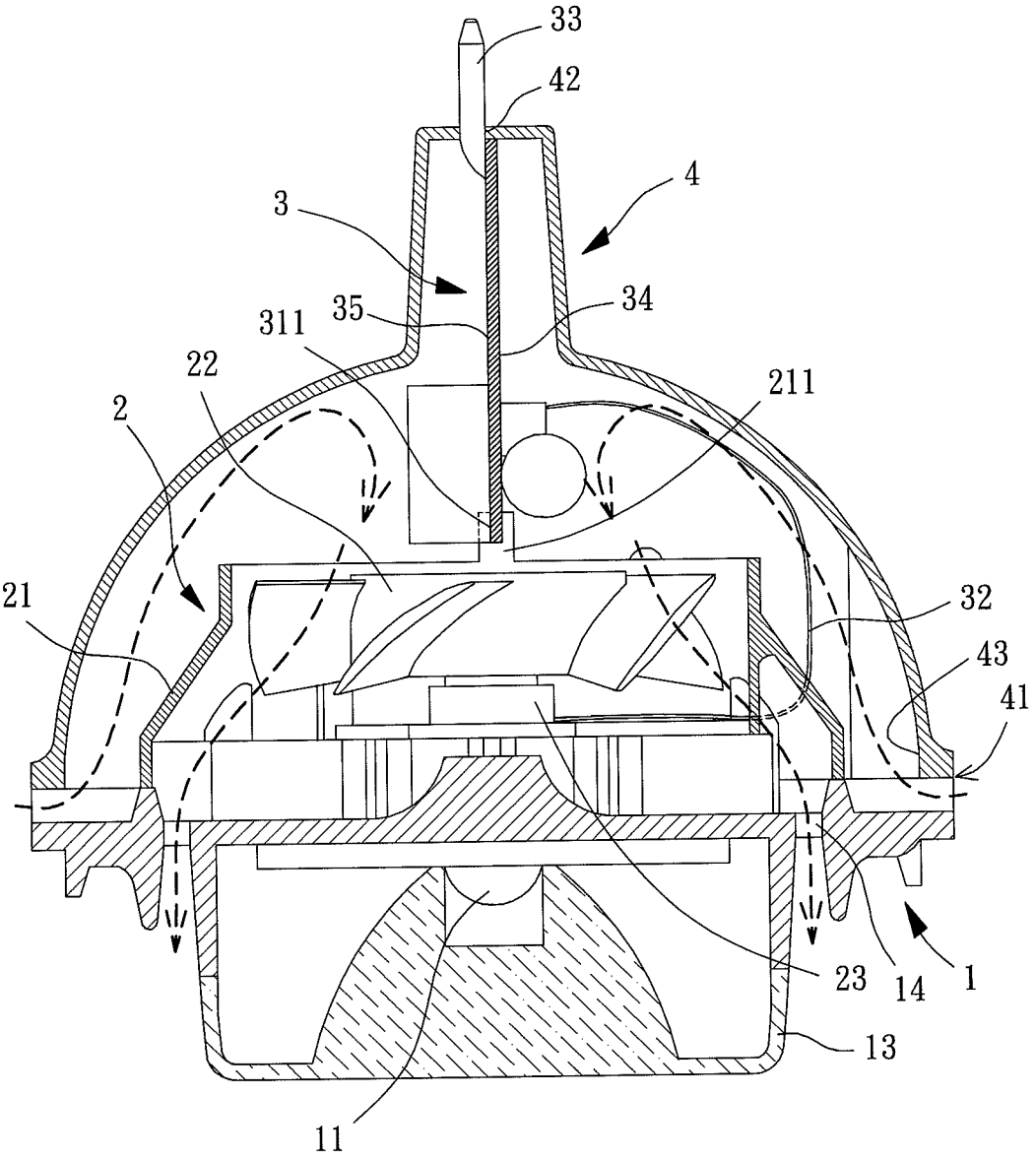
FIG. 4 is a cross-sectional view of the lamp according to the first embodiment and showing airflows in the lamp.

Referring to FIGS. 2, 3 and 4, a first embodiment of a lamp of this invention is shown, which includes a base 1, a cooling fan 2 and a circuit board 3. The base 1 is adapted to support the cooling fan 2. The circuit board 3 couples with the cooling fan 2 and is capable of connecting with an external power source, and thus the circuit board 3 can drive the cooling fan 2 by electrical power provided by the power source. Consequently, airflows driven by the cooling fan 2 can cool the heat in this lamp, such as the heat generated by the circuit board 3.

Specifically, there is a LED member 11 mounted on the base 1 powered by the circuit board 3 or the external power source for illumination. The base 1 can further provide a coupling portion 12 for the cooling fan 2 to mount on, with the coupling portion 12 in a form that is able to couple with the cooling fan 2, such as a buckling, screwing or adhesion structure. In this embodiment, the base 1 is made of heat conductive material. Preferably, the base 1 is a heat sink with a plurality of cooling fins. One end of the base 1 couples with the LED member 11 and has a light transmittable bulb 13 for covering and protecting the LED member 11 and enhancing the illumination performance of the LED member 11. Another end of the base 1 has the coupling portion 12, which preferably includes a plurality of thread holes 121 for the base 1 to be screwed with the cooling fan 2. The base 1 can also include at least one air guiding passage 14 extending from one of the ends to the other one of the ends to serve as an air inlet or an air outlet for dissipating heat of the LED member 11 and the circuit board 3 when the cooling fan 2 operates.

As shown by FIG. 3, the cooling fan 2 has a frame 21, a fan wheel 22 and a driving unit 23. The frame 21 receives the fan wheel 22 and driving unit 23, and the fan wheel 22 couples with the driving unit 23 in a rotatable way. The driving unit 23 is a device capable of driving the fan wheel 22 to rotate for generating airflows and may include elements of a motor stator, such as coils, silicon steel plates and a driving circuit, which are constructed by conventional motor structures. The frame 21 is coupled with the coupling portion 12 of the base 1, and the frame 21 has a first fixing portion 211 for the circuit board 3 to mount on, with the first fixing portion 211 being in a form that is able to couple with the circuit board 3, such as a buckling, screwing or adhesion structure. In this embodiment, there is a plurality of connecting flanges 24 formed at an outer periphery of the frame 21. The plurality of connecting flanges 24 has a plurality of through holes 241 aligning with the thread holes 121 of the base 1 for the frame 21 to be firmly mounted on the base 1. Preferably, the first fixing portion 211 includes two slits aligning with each other, so that the circuit board 3 can be detachably inserted into the slits for coupling with the frame 21. Specifically, referring to FIG. 2, the two slits serving as the first fixing portion 211 are formed in two axial protrusions of a lateral wall of the frame 21.

The circuit board 3 has a second fixing portion 31 for coupling with the first fixing portion 211 of the frame 21, so that the circuit board 3 can be initially and electrically connected with the driving unit 23 once the circuit board 3 is coupled with the frame 21 via the first and second fixing portions 211, 31. In this embodiment, the second fixing portion 31 is constructed by an edge of the circuit board 3, which inserts into the two slits of the frame 21. Preferably, the second fixing portion 31 includes two blocks 311, with a distance between these two blocks 311 preferably being equal to a distance between two outmost surfaces of the lateral wall having the first fixing portion 211. Accordingly, referring to FIG. 3, the two blocks 311 can respectively engage the two outmost surfaces of the lateral wall when the edge of the circuit board 3 serving as the second fixing portion 31 is inserted into the two slits serving as the first fixing portion 211 of the frame 21. Therefore, the circuit board 3 is prevented from lateral movement relative to the cooling fan 2 since the first fixing portion 211 is clamped in the second fixing portion 31 of the circuit board 3 while the two blocks 311 sandwich the lateral wall of the frame 21. Moreover, the circuit board 3 has a power line 32 electrically linking the electrical elements of the circuit board 3 and the driving unit 23 of the cooling fan 2.

Figure 5:
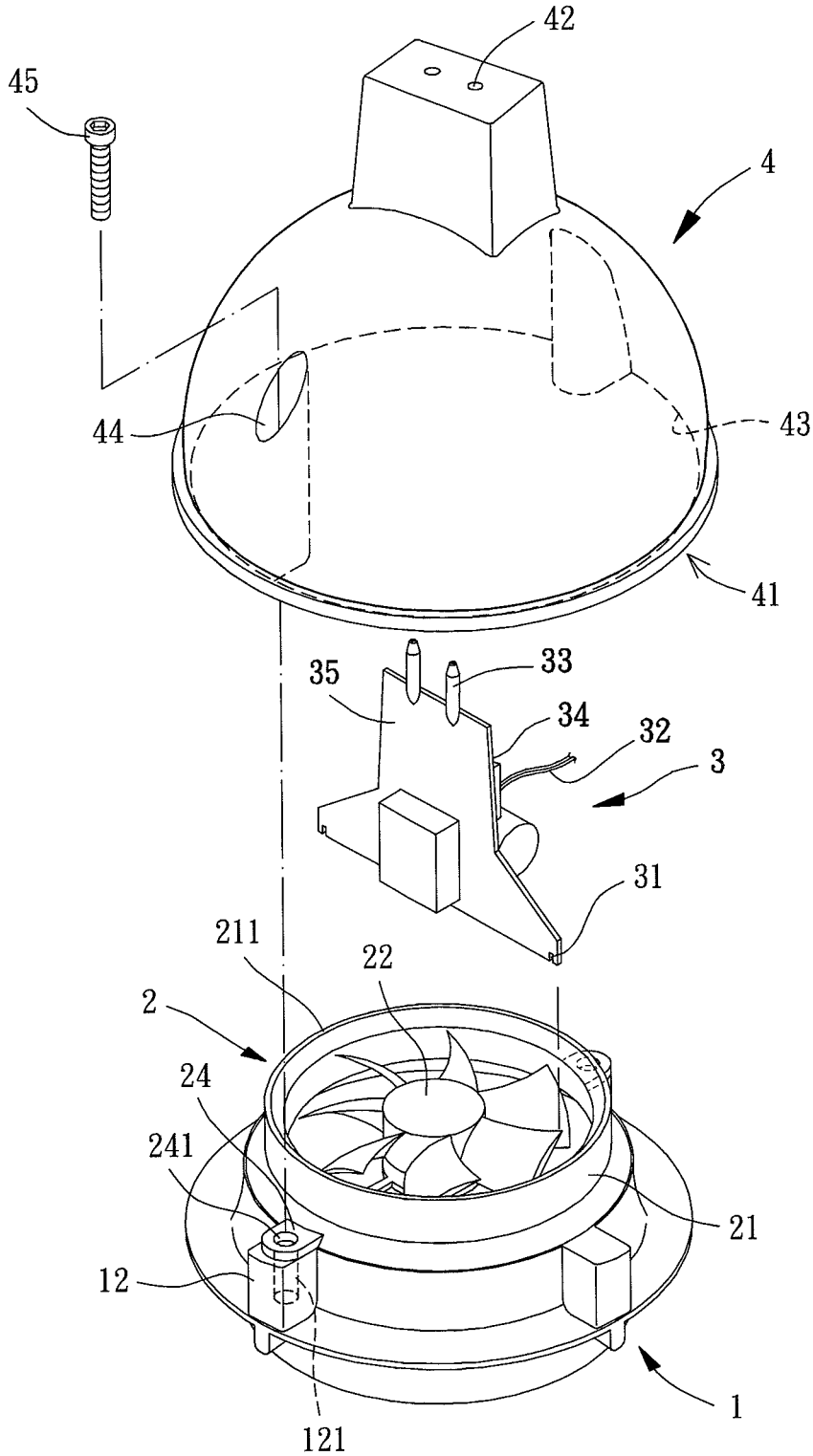
FIG. 5 is a perspective and exploded view of a lamp according to a second embodiment of the invention.
Figure 6:
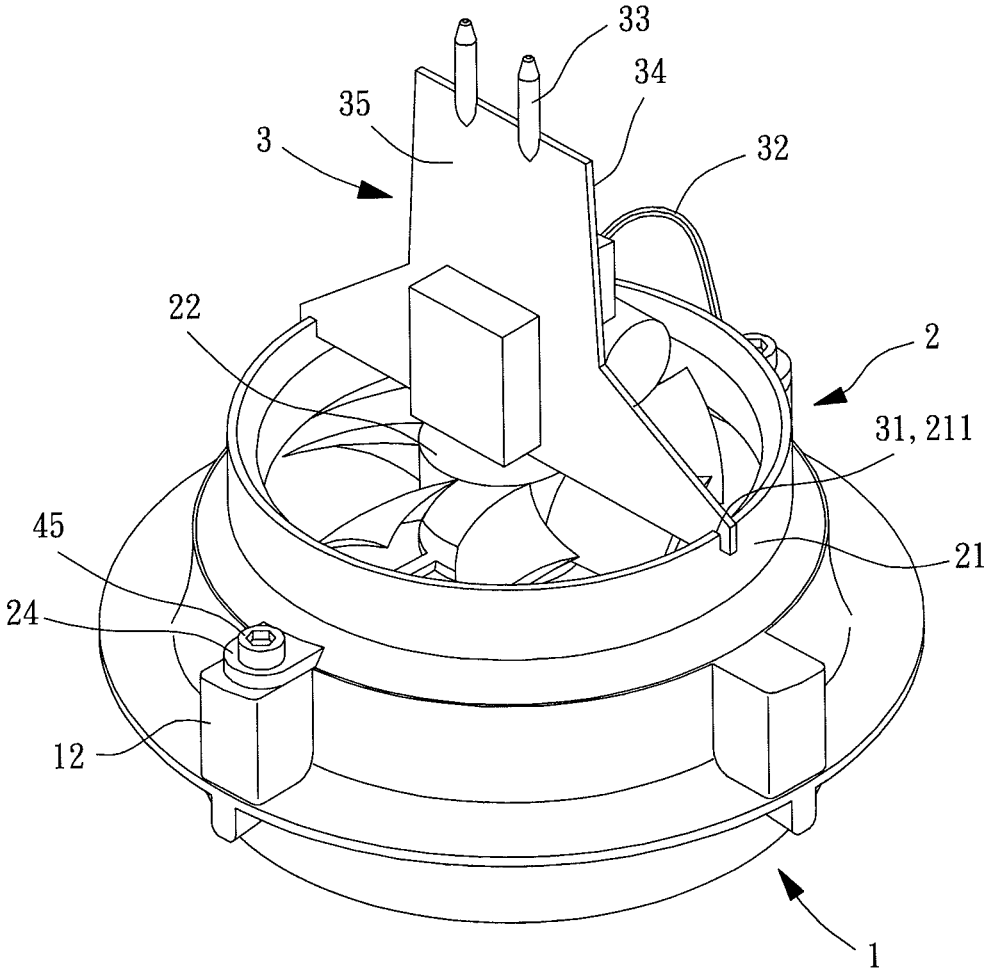
FIG. 6 is a perspective and assembled view of the lamp according to the second embodiment of the invention.

Referring to FIGS. 5 and 6, a second embodiment of a lamp of this invention is shown. In this second embodiment, the second fixing portion 31 of the circuit board 3 is an edge including two slits, and the first fixing portion 211 is an end of the lateral wall of the frame 21, with the end facing the circuit board 3. Therefore, the lateral wall of the frame 21 serving as the first fixing portion 211 can be fixed in the two slits of the second fixing portion 31 of the circuit board 3.

In accordance with the above disclosed embodiment, the primary character of this invention lies in that the first fixing portion 211 of the frame 21 and the second fixing portion 31 of the circuit board 3 can be firmly coupled with each other. With this arrangement, in assembly, the circuit board 3 can be coupled with the cooling fan 2 initially, and thus the circuit board 3 can be electrically connected to the driving unit 23 easily before the cooling fan 2 and circuit board 3 are mounted onto the base 1. As a result, the power line 32 of the circuit board 3 does not have to be arranged in a complex, sinuous, and long route for the electrical connection between the cooling fan 2 and the circuit board 3, which results in an improvement in convenience of assembling of the invented lamp. Besides, since the circuit board 3 is directly coupled with the cooling fan 2 without any other element in-between, the cooling fan 2 can efficiently dissipate the heat generated by the circuit board 3 when drawing or dispelling the air. Therefore, the lifetime of the disclosed lamp is increased.

Moreover, based on the above disclosures, there may be other features arranged in the embodiments of this invention to provide more functions, which are discussed in the following.

Referring to FIGS. 2 and 3, it is preferable for the lamp to have a housing 4 with a receiving room inside. The housing 4 has an assembly opening 41 at an end and a plurality of positioning holes 42 at another end. The assembly opening 41 and positioning holes 42 communicate with the receiving room of the housing 4, so that the base 1, cooling fan 2 and circuit board 3 can be inserted into the receiving room via the assembly opening 41 and be protected by the housing 4. Furthermore, an inner wall of the receiving room adjacent to the assembly opening 41 serves as an air guiding wall 43 for forming an air channel between the frame 21 of the cooling fan 2 and the air guiding wall 43 of the housing 4. Accordingly, the air guiding wall 43 helps the air-drawing or air-dispelling function of the air guiding passage 14 of the base 1.

Referring to FIGS. 2 and 3 again, there is a plurality of electric connection pins 33 arranged on another edge of the circuit board 3 opposite to the one having the second fixing portion 31. The electric connection pins 33 are electrically connected with the electrical elements of the circuit board 3 and extend through the positioning holes 42 to fix the position of the circuit board 3 relative to the housing 4. Accordingly, the circuit board 3 can be firmly sandwiched between the housing 4 and the frame 21 since the two opposite edges of the circuit board 4 are coupled with the first fixing portion 211 of the frame 21 and the positioning holes 42 of the housing 4 respectively.

Referring to FIGS. 2 and 3 still, the housing 4 can further have a plurality of apertures 44. Each aperture 44 is aligned with a respective one of the through holes 241 of the cooling fan 2 and a respective one of the thread holes 121 of the base 1, so that fixing members 45 such as screws can pass through the apertures 44 and through holes 241 to engage in the thread holes 121. Consequently, the housing 4, cooling fan 2 and base 1 can be conveniently combined together in a single step.

Now, referring to FIGS. 2 through 4, two opposite and spaced surfaces of the circuit board 3, which extend from the edge serving as the second fixing portion 31 to the other edge having the electric connection pins 33, are defined as a first surface 34 and a second surface 35 respectively. The electrical elements are arranged on at least one of the first and second surfaces 34, 35. Since the second fixing portion 31 of the circuit board 3 is adjacent to the cooling fan 2 and the electric connection pins 33 are adjacent to the positioning holes 42 of the housing 4, it is apparent that the circuit board 3 inside the housing 4 is in a standing state, with the first and second surfaces 34, 35 facing the inner wall of the receiving room the housing 4. As a result, with the above described arrangement, airflows can be guided to move in a direction along the first and second surfaces 34, 35 when the cooling fan 2 drives the airflows to enter or exit the housing 4 via the air guiding passage 14 or the air channel, and thus the heat generated by the electrical elements of the circuit board 3 can be efficiently dispelled.

In sum, since the first fixing portion 211 of the frame 21 and the second fixing portion 31 of the circuit board 3 can be initially combined in assembly for the circuit board 3 and the cooling fan 2 to be electrically connected with each other conveniently, the lamp is improved in manufacture convenience. Besides, a better performance in cooling is also provided by directly arranging the circuit board 3 above the frame 21 of the cooling fan 2 for the cooling fan 2 to efficiently dissipate the heat generated by the circuit board 3.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A lamp comprising:

a base having a coupling portion, with a LED member mounted on the base;

a cooling fan having a frame coupled with the coupling portion of the base, wherein the frame receives a driving unit and a fan wheel coupling with the driving unit in a rotatable way and has a first fixing portion;

a circuit board having a second fixing portion coupling with the first fixing portion of the frame, with the circuit board electrically connecting with the driving unit of the cooling fan; and a housing with a receiving room inside, wherein an assembly opening is formed at an end of the housing and communicates with the receiving room, with the base, the cooling fan and the circuit board being arranged in the receiving room, wherein a plurality of positioning holes is formed at another end of the housing, a plurality of electric connection pins is arranged on an edge of the circuit board to extend through the positioning holes of the housing, and the circuit board is firmly positioned between the housing and the frame.

2. The lamp as claimed in claim 1, wherein electrical elements are arranged on at least one surface of the circuit board, with the at least one surface being between the second fixing portion and the electric connection pins, and wherein the second fixing portion of the circuit board is adjacent to the cooling fan and the electric connection pins are adjacent to the positioning holes of the housing for the circuit board inside the housing to be in a standing state.

3. The lamp as claimed in claim 1, wherein an inner wall of the receiving room adjacent to the assembly opening serves as an air guiding wall, and an air channel is formed between the frame of the cooling fan and the air guiding wall of the housing.

4. A lamp comprising:

a base having a coupling portion, with a LED member mounted on the base;

a cooling fan having a frame coupled with the coupling portion of the base, wherein the frame receives a driving unit and a fan wheel coupling with the driving unit in a rotatable way and has a first fixing portion;

a circuit board having a second fixing portion coupling with the first fixing portion of the frame, with the circuit board electrically connecting with the driving unit of the cooling fan; and a housing with a receiving room inside, wherein an assembly opening is formed at an end of the housing and communicates with the receiving room, with the base, the cooling fan and the circuit board being arranged in the receiving room, wherein the coupling portion of the base comprises a plurality of thread holes, an outer periphery of the frame has a plurality of through holes, the housing has a plurality of apertures, each aperture is aligned with a respective one of the through holes of the cooling fan and a respective one of the thread holes of the base, and fixing members pass through the apertures and the through holes to engage in the thread holes.

5. A lamp comprising:

a base having a coupling portion, with a LED member mounted on the base;

a cooling fan having a frame coupled with the coupling portion of the base, wherein the frame receives a driving unit and a fan wheel coupling with the driving unit in a rotatable way and has a first fixing portion; and a circuit board having a second fixing portion coupling with the first fixing portion of the frame, with the circuit board electrically connecting with the driving unit of the cooling fan, wherein the first fixing portion of the frame comprises two slits aligning with each other, the second fixing portion of the circuit board is an edge of the circuit board, and the edge is inserted into the two slits of the frame.

6. The lamp as claimed in claim 5, wherein the edge serving as the second fixing portion has two blocks, these two blocks are spaced with a distance, and the two blocks engage two outmost surfaces of a lateral wall having the two slits respectively.

7. The lamp as claimed in claim 5, wherein the two slits are formed in two axial protrusions of a lateral wall of the frame.

8. A lamp comprising:

a base having a coupling portion, with a LED member mounted on the base;

a cooling fan having a frame coupled with the coupling portion of the base, wherein the frame receives a driving unit and a fan wheel coupling with the driving unit in a rotatable way and has a first fixing portion; and a circuit board having a second fixing portion coupling with the first fixing portion of the frame, with the circuit board electrically connecting with the driving unit of the cooling fan, wherein the second fixing portion of the circuit board is an edge including two slits, the first fixing portion of the frame is an end of a lateral wall of the frame facing the circuit board, and the lateral wall of the frame is fixed in the two slits of the second fixing portion of the circuit board.

9. The lamp as claimed in claim 1, wherein the base is a heat sink with a plurality of cooling fins.

10. The lamp as claimed in claim 1, wherein one end of the base has a light transmittable bulb for covering the LED member.

11. The lamp as claimed in claim 1, wherein the base includes at least one air guiding passage extending from one end of the base to another end of the base.

12. The lamp as claimed in claim 4, wherein an inner wall of the receiving room adjacent to the assembly opening serves as an air guiding wall, and an air channel is formed between the frame of the cooling fan and the air guiding wall of the housing.

13. The lamp as claimed in claim 5, wherein an inner wall of the receiving room adjacent to the assembly opening serves as an air guiding wall, and an air channel is formed between the frame of the cooling fan and the air guiding wall of the housing.

14. The lamp as claimed in claim 8, wherein an inner wall of the receiving room adjacent to the assembly opening serves as an air guiding wall, and an air channel is formed between the frame of the cooling fan and the air guiding wall of the housing.

15. The lamp as claimed in claim 4, wherein the base is a heat sink with a plurality of cooling fins.

16. The lamp as claimed in claim 5, wherein the base is a heat sink with a plurality of cooling fins.

17. The lamp as claimed in claim 8, wherein the base is a heat sink with a plurality of cooling fins.

18. The lamp as claimed in claim 4, wherein one end of the base has a light transmittable bulb for covering the LED member.

19. The lamp as claimed in claim 5, wherein one end of the base has a light transmittable bulb for covering the LED member.

20. The lamp as claimed in claim 8, wherein one end of the base has a light transmittable bulb for covering the LED member.

* * * * *